US011045693B1

(12) United States Patent
Allen

(10) Patent No.: US 11,045,693 B1
(45) Date of Patent: Jun. 29, 2021

(54) GOLF CLUB HEAD WITH HIGH SPRING RATE FACE ASSEMBLY

(71) Applicant: Dillis V. Allen, Schaumburg, IL (US)

(72) Inventor: Dillis V. Allen, Schaumburg, IL (US)

(73) Assignee: Vardon, Inc., Schaumburg, IL (US)

( * ) Notice: Subject to any disclaimer, the term of this patent is extended or adjusted under 35 U.S.C. 154(b) by 0 days.

(21) Appl. No.: 15/970,557

(22) Filed: May 3, 2018

(51) Int. Cl.

| | |
|---|---|
| ***A63B 53/06*** | (2015.01) |
| ***A63B 53/04*** | (2015.01) |
| ***A63B 60/42*** | (2015.01) |
| *A63B 102/32* | (2015.01) |
| *A63B 53/08* | (2015.01) |

(52) U.S. Cl.
CPC ..... *A63B 53/0466* (2013.01); *A63B 60/42* (2015.10); *A63B 53/0425* (2020.08); *A63B 53/06* (2013.01); *A63B 53/08* (2013.01); *A63B 2102/32* (2015.10)

(58) Field of Classification Search
CPC . A63B 53/0466; A63B 60/42; A63B 2102/32; A63B 2053/0425; A63B 53/08; A63B 53/06
See application file for complete search history.

(56) References Cited

U.S. PATENT DOCUMENTS

| | | | | |
|---|---|---|---|---|
| 3,595,326 | A * | 7/1971 | Claycomb | E21B 7/062 175/73 |
| 4,339,007 | A * | 7/1982 | Clark | E21B 4/02 175/107 |
| 5,505,453 | A * | 4/1996 | Mack | A63B 53/04 473/329 |
| 5,890,973 | A * | 4/1999 | Gamble | A63B 21/0602 473/326 |
| 5,911,637 | A * | 6/1999 | Yamagata | A63B 53/04 473/333 |
| 6,354,956 | B1 * | 3/2002 | Doong | A63B 53/0466 473/219 |
| 6,976,924 | B2 * | 12/2005 | Gilbert | A63B 53/04 473/332 |
| 10,150,019 | B2 * | 12/2018 | Ines | A63B 53/047 |

* cited by examiner

*Primary Examiner* — Stephen L Blau

(57) ABSTRACT

A golf club head with a high spring rate face assembly, particularly one designed for driver-type heads, including a body with a ball striking face and rearwardly extending depending sole and crown walls and a hosel, with a high spring rate annular spring seated against the rear surface of the face with a short spring height, where the spring has a high face force to deflection ratio, and is preloaded against the face.

19 Claims, 5 Drawing Sheets

GOLF CLUB HEAD WITH HIGH SPRING RATE FACE ASSEMBLY

BACKGROUND OF THE PRESENT INVENTION

The technological revolution in golf over the last three decades has been truly remarkable. When Jack Nicklaus and Arnold Palmer were at their competitive peaks in the 1960s, the average distance by these stars with driver-type clubs was on the order of 250 yards. Yet today, well into the revolution, the long drivers, such as Dustin Johnson, Rory McGilroy, Jason Day, Justin Thomas, and several others, frequently drive the ball over 340 yards. A significant amount of this improvement, if not the majority, is due to golf ball improvement, but the thrust of the present case is golf driver-type technology, so these comments are confined to the latter.

These improvements in ball distance have resulted in the myopic redesign and lengthening of many golf courses, particularly those on which professional tournaments are conducted, to the dismay of course ownership, tournament sponsors and the United States Golf Association (USGA), the governing body of golf in the United States, and the Royal and Ancient (R&A), the governing body of golf in Europe and many other countries.

The USGA has tried in vain to inhibit golf technology advances in the name of golf history and tradition, but it has been largely unsuccessful because of meager USGA balance sheet resources, and the claims of golf enthusiasts and equipment manufacturers for new products and game improvement for the average golfers, who pay dollars for their golf equipment.

When the USGA began regulating the design and shape of the grooves on club faces to minimizing ball spin as the ball exits its face, Karsten Manufacturing filed suit against the USGA to prevent groove regulation, prevailing with a settlement agreement permitting that Karsten's new model irons, the Ping Eye, to be grandfathered in as "conforming", an exception that lives to this day.

And when the USGA found in the 1990s that it would no longer enforce its rule outlawing any spring effect of golf clubs, the USGA changed the rule, but limited the maximum spring effect first by limiting ball exit velocity from the club face $$\left(\frac{\text{Velocity Out,}}{\text{Velocity Out}} = < .83\right)$$

and after finding the measurement of this technique too costly because it requires a ball gun and large laboratory, it came up with the idea of limiting the contact time of the ball on the club face to no more than 239 us—as measured by a proprietary pendulum known only to the USGA and its high paying licensees. See *USGA Procedure For Measuring the Flexibility of a Golf Clubhead, USGA-TPX*3004, Revision 1.0.0, May 1, 2008. Any competent physicist would tell the student public that contact duration varies significantly with the modulus of elasticity ($E_o$) of the golf club head—so that its (USGA) prohibitions are only valid for one club head material—titanium. No one has disagreed with the USGA on this factual point because most pro-line clubs today (2018), are made of titanium alloys—but no doubt when better materials are devised the contact duration test will no longer be valid—because in fact it is mathematically invalid today.

Golf club ball impact theory is not overly complicated.

The velocity of the club head, together with its mass, determine its kinetic energy and momentum. As the swing progresses, the golfer applies more and more force to the club head causing it to accelerate and so increase its speed. Therefore its momentum and energy increase. Upon impact, some of this energy and momentum is transferred to the ball. To determine the speed of the ball as it leaves the club face, we use conservation of both energy and momentum. Let $m_{club}$ and $m_{ball}$ denote the mass of the club and the ball, respectively. Let $v_{club}$ and $v_{ball}$ denote their speeds right after impact, and let $v_{club}$ denote the speed of the club head just before impact. (Of course the speed of the ball just before impact is zero). Since $E=mv^2/2$, conservation of energy tells us that $$\frac{1}{2}m_{club}v_{club}^2 = \frac{1}{2}m_{club}V_{club}^2 + \frac{1}{2}m_{ball}v_{ball}^2,$$

While conservation of momentum tells us that $$m_{club}v_{club}=m_{club}V_{club}+m_{ball}v_{ball}.$$

The solution to these equations is easily found:

$$V_{club} = v_{club}\frac{m_{club} - m_{ball}}{m_{club} + m_{ball}},\ v_{ball} = v_{club}\frac{2m_{club}}{m_{club} + m_{ball}} = v_{club}\frac{2}{1 + m_{ball}/m_{club}}.$$

Thus the ratio of the ball speed to the speed of the club head before impact is 2/(1+r) where r is the ratio of the mass of the ball to the mass of the club head. Notice that, no matter how small the ratio of masses, the ball speed will always be less than twice the club head speed. For instance, if $v_{club}=_{54}0.0$ meters per second (about 120 miles per hour), $m_{club}=0.195$ kilograms, and $m_{ball}$ 0.0459 kilograms, then $v_{ball}$ is about 87.4 meters per second or just about 195 miles per hour.

In reality, not all of the kinetic energy lost by the club head during impact is converted into kinetic energy of the ball. That is the impact is not perfectly elastic. Some energy is lost to heat and damage to the ball. In this case, the ball launch speed is given by $$v_{ball} = \frac{(1 + c_R)v_{club}}{1 + m_{ball}/m_{club}}$$

Where $c_R$ is called the coefficient of restitution. For an elastic collision, $c_R=1$, but in reality it is somewhat smaller. Using a typical value of $C_R=0.78$, we obtain a launch velocity $v_{ball}=77.8$ meters per second, or about 175 miles per hour. Even to the nonspecialist, this formula conveys a sense that math impinges on golf.

The period of contact of the club head with the ball is about one two-thousandth of a second. During this time the center of mass of the ball has barely moved, but the ball is bent significantly out of shape. A significant portion of the kinetic energy has been converted into potential energy stored in the deformed ball. Essentially, the ball is like a compressed spring. When the ball takes off from the tee, it returns to a spherical shape, releasing the spring, and most of this potential energy is converted back into kinetic energy. Detailed analyses of the club head/ball interaction can be made through a full 3-dimensional finite element analysis or via simplified 1- or 2-dimensional models.

The following provides the basis for the USGA's limitations on ball exit velocity.

The coefficient of restitution, or COR, measures the velocity ratio during an impact event. COR is represented as a ratio, with a value from 0 to 1. A COR with a value of o represents a perfectly inelastic collision. An example of this would be two bodies coming to a complete stop during impact. A COR with a value of 1 portrays a perfectly elastic collision, in which no energy is lost during impact. Usually COR is measured in terms of pre and post impact velocities. For example, take a ball hitting a rigid plate with an initial velocity of 100 mph, and a post impact velocity of 80 mph. This impact has a COR of 0.80 or 80% of the ball's energy was returned to the ball after impact. This equation below shows the most basic COR formulation.

$$COR = e = \frac{V_{out}}{V_{in}}$$

The USGA limited the COR in drivers to 0.830 in 1998, while the other governing body for golf outside the US, the Royal and Ancient Golf Club of St. Andrews (R&A), did not impose a limit on COR at that time. This caused confusion as to what drivers were allowed during play, especially for international events. In May of 2002, talks between the two governing bodies unveiled a proposal to establish the limit from 0.830 to 0.860 to create some uniformity around the globe. Some manufacturers began producing drivers that exceeded the 0.830 limit in July of 2002, even though the rule was not yet official. This caused signification turbulence when the USGA decided to maintain its limit of 0.830, and the R&A decided it would enact the same limit beginning in 2008. These new drivers with nonconforming COR, or "hot" drivers, were deemed illegal for all tournament play and handicap based rounds.

With the introduction of these limits, the USGA needed a test procedure to measure a driver's COR. Originally, a ball was fired by air cannon into a specimen and pre and post impact velocities were compared to find COR. This process took a significant amount of time to perform when considering the set up (scribing clubs, finding center of gravity, etc. . . . ) and the controls associated with the golf balls used in the test. Today, the COR is measured using the "Characteristic Time" test, which consists of a steel ball with sensors on a pendulum being swung into a clubface. The length of time the steel ball is in contact with the face determines the COR. For the purpose of this analysis, the model will refer back to the original air cannon testing procedure.

There have also been many engineers and theorists examining the relation between ball contact time and ball exit velocity.

The effects of club head speed and ball compression illustrated can be compared with theoretically obtained values. Hertz law of contact, which was originally developed for static contact, relates the contact force, F to the contact approach deformation.

Hertz law of contact is also applicable to colliding bodies, providing that the contact area is small compared to the dimensions of the colliding bodies, and the duration of impact long in comparison with the period of the lowest mode of vibration of the bodies. Although a golf impact does not meet these requirements, Hocknell (1998) showed that a reasonable estimation of impact duration, r, could still be achieved with the following formula, derived from Hertz Law (Goldsmith, 1960).

$$\tau = 4.53\left[\frac{m_B(\delta_A + \delta_B)}{\sqrt{(R_B v_0)}}\right]^{2/5}$$

Where, $$\delta_A = \frac{1 - v_A^2}{\pi E_A} \text{ and } \delta_B = \frac{1 - v_B^2}{\pi E_B}$$

The following are typical values: for a titanium club head, Young's modulus EA=110 $GNm^{-2}$ and Poisson's Ration $V_A$=0.33, and for a golf ball, mass $m_B$=0.0449 $K_g$ and radius $R_B$=0.02133 m. In the study by Hocknell (1998), the value of Young's modulus for the core material of a golf ball was found to be strain rate dependent. From status compression tests, a Young's modulus of 85.7 $MNm^{-2}$ was obtained at a low strain rate, increasing to 164.4 $MNm^{-2}$ when the strain rate was increased to the highest available of 10 $ms^{-1}$. In addition, a value of 0.48 was used for Poisson's ratio. Other studies have reported values of 50 $MNm^{-2}$ and 0.49 (Thomson et al., 1990) and 103.4 $MNm^{-2}$ and 0.49 (Chou et al., 1994) for Young's modulus and Poisson's ratio respectively.

Theoretical curves, obtained using values from each aforementioned study input are plotted alongside experimental data. It can be shown that the experimental results fall well within the limits of the two extreme curves and show good agreement with the curves obtained using values of Young's modulus of 85.7 and 103.4 MNm-2. This is perhaps unexpected considering the strain rate of a golf ball during impact is greater than 30 ms-1 and it follows from the findings by Hocknell (1998) that under such loading the ball will behave in a stiffer manner and, therefore, a larger value of Young's modulus would be anticipated to be more representative. It can also be seen that the gradient of the experimental curves is marginally greater with impact durations approximately proportional to $v_o^{-1/4}$ rather than $v_o^{-1/5}$ as proposed by Hertz.

Investigations into the effect of club head type and ball construction revealed that the ball has a more significant effect on impact duration than the club head. The impact duration with three-piece wound balls was found to be in the region of 16 us longer than with two-piece balls. In contrast, the difference between the oversize titanium club head that produced the longest impact duration and the steel club head that produced the shortest was 12 us. The ball compression was also found to have a significant effect, with impact durations of 80 compression balls on average 44 us longer than 100 compression balls of the same construction. Finally, the club head speed at impact was found to effect impact duration, with the duration of impact reducing by approximately 65 us over the $22.3^{ms\text{-}1}$ speed range used. Experimental results showed reasonable agreement with theoretically obtained values but, when compared with golfers' perceptions, little correlation was found. This suggests that the perceptions of golfers are influenced by other factors, such as the sound of the impact.

The spring effect of driver-type club heads began in the early 1990s with honeycomb technology explained and claimed in the Raymont, U.S. Pat. No. 3,847,399, owned by Vardon Golf Company, mostly used in investment cast stainless steel club heads, was in wide use by manufacturers at that time. Thereafter, head designers began using recesses or folds in the rearward walls of the club head to simulate accordion type springs. Some of these are in use today, such as those made by Adams Golf Company of Carlsbad, Calif.

At the same time, designers began tinkering with the club face design, including changing face materials to beta titanium alloys, and thinning the face to achieve greater face flexation.

One concept that has achieved success is variable face thickness (VFT) which includes thinning the face surface around the perimeter of the face to between 2 to 2.5 mm. and thickening the face in an elliptical central ball striking area to 3 to 4 mm. Using these techniques and some others, club makers have no difficulty in achieving the maximum COR of 0.83 or the maximum contact duration of 239 us.

The trade-off to this design exercise is high and expensive quality control and increasing face failure.

Face failure, however, is not the visual cracking or breaking of the face wall or other parts of the golf clubs that exceed the USGA limits, for the average golfer to hit the golf ball further than his buddies with equal swing speeds, but instead a flattening of the design face curvature of "roll" and "bulge", resulting in markedly poor performance, particularly a diminution in ball exit velocity.

It could be beneficial to the golf industry, if techniques were developed, as here, to increase the spring effect of the club head, to not only maintain the USGA limits, but also to design golf clubs exceeding the limits of the USGA, since its rules will no doubt be altered again by industry pressure, or if not, by the ever increasing market for head body.

SUMMARY OF THE PRESENT INVENTION

In accordance with the present invention, a golf club head with a high spring rate face assembly is provided, particularly one designed for driver-type heads, including a body with a ball striking face and rearwardly extending depending sole and crown walls and a hosel, with a high spring rate annular spring seated against the rear surface of the face with a short spring height, where the spring has a high face force to deflection ratio, and is preloaded against the face.

The high spring rate of the spring is best achieved with a Belleville type spring, but other types of springs may be employed if designed to provide similar spring rates, heights and widths.

The spring design is selected to match the golfer's swing speed.

With today's professional golfers, swing speeds can approach 135 miles per hour, about 198 ft/sec. Impact forces for these players range from 2,000/lbs. to 5,000/lbs. The maximum spring deflection force achieved at maximum face wall deflection of the swing for these golfers should be in the same range 2,000 to 5,000 lbs. so the club face is not compressed beyond the limit of the spring.

For slower swing players, in the range of 80 mph to 100 mph, the maximum spring deflection is in the range of 1,000 to 2,000/lbs.

The face wall support provided by the Belleville spring, particularly when preloaded, permits the face wall to be thinner than today's face walls, much lower than the 3 mm+range of today's face walls, down to much thinner, even below 0.065 inches, without face cracking or other club head wall failure, or the face flattening discussed above. Preloading the spring not only increases the face wall integrity but also increases the force range of the club head, increasing the effective spring rate. This enables the use of a lower spring rate spring to achieve an effective higher spring rate because the force required to overcome the spring preload shifts the force deflection segment of a given golf ball impact upwardly so the actual deflection cycle to occur at a higher spring rate. Of course, the preload of the spring, as well as the spring, needs to be selected for a given swing speed so the spring achieves a maximum deflection below the fully compressed size of the spring itself.

DETAILED DESCRIPTION OF THE PREFERRED EMBODIMENT

Figure 1:
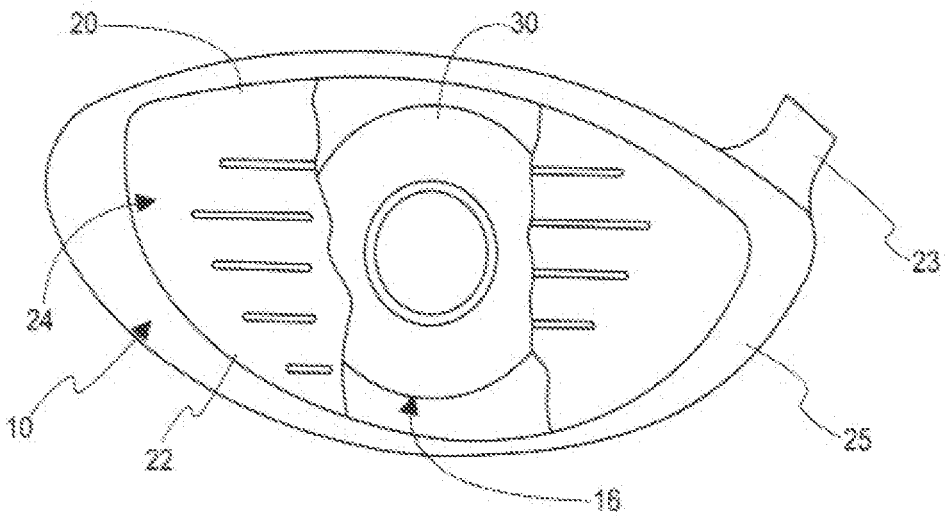
FIG. 1 is a front view of a golf club head with a high spring rate face assembly with the club face broken away to view a portion of the spring and face wall support assembly.
Figure 2:
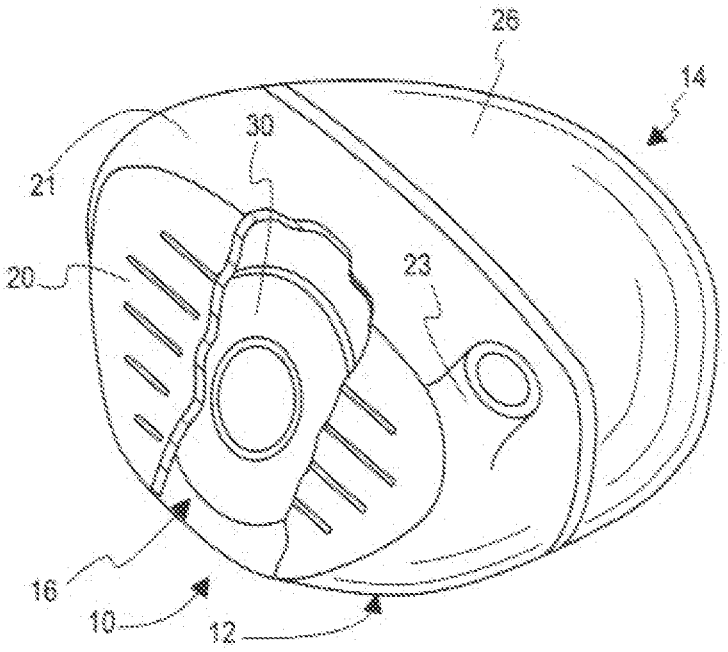
FIG. 2 is a right side perspective view of a golf club head with a high spring rate face assembly with the cup-shaped face assembly broken away.

Viewing the drawings and particularly FIGS. 1 to 9, a club head 10 is. illustrated according to the present invention, consisting generally of a forward cup-shaped face assembly 12 and a rear body assembly 14.

The cup-shaped face assembly 12, as well as the other parts of the club head body 10, are constructed of a beta titanium material because of its high modulus of elasticity, hardness, durability, and efficacy as a driving-type club. The cup-shaped face wall assembly 12 has a face 20 and rearwardly depending crown wall portion 21, sole wall portion 22, and a hosel 23, along with more general designations of a toe portion 24 and a heel portion 25.

It should be understood that the cup-shaped face wall assembly 12 can be manufactured in a variety of configurations including casting, as well as forging.

The face wall 20 may be manufactured separately from the cup-shaped face assembly 12 and thereafter pressed or welded into the cup-shaped face wall assembly 21 enabling the face wall to have different mechanical properties than the remainder portions of body 10. The loft angle of the face wall 20 for a driver-type club can range from 6° to 10.5° for professional golfers, and 10.5° to 13.5° for amateur-type golfers with slower swing speeds.

Furthermore, the face wall 20 may be constructed of a different titanium alloy than the cup-shaped face assembly 12, as well as the rear body 14.

The rear body 14 also may be constructed of different materials including carbon-carbon resin layered material. Using the carbon-carbon technique, the crown wall 21 in the cup-shaped face assembly 12, as well as crown wall 26 in rear body 14, may be constructed of a very thin wall to lighten the overall weight of the club head 10, and in fact can be as thin as 0.025 in. The sole wall 22 in the forward cup-shaped face assembly 12, as well as sole wall 29 (see FIG. 9) may be constructed of a thin titanium material and also may be utilized to vary the center of gravity position within the club head 10.

Figure 9:
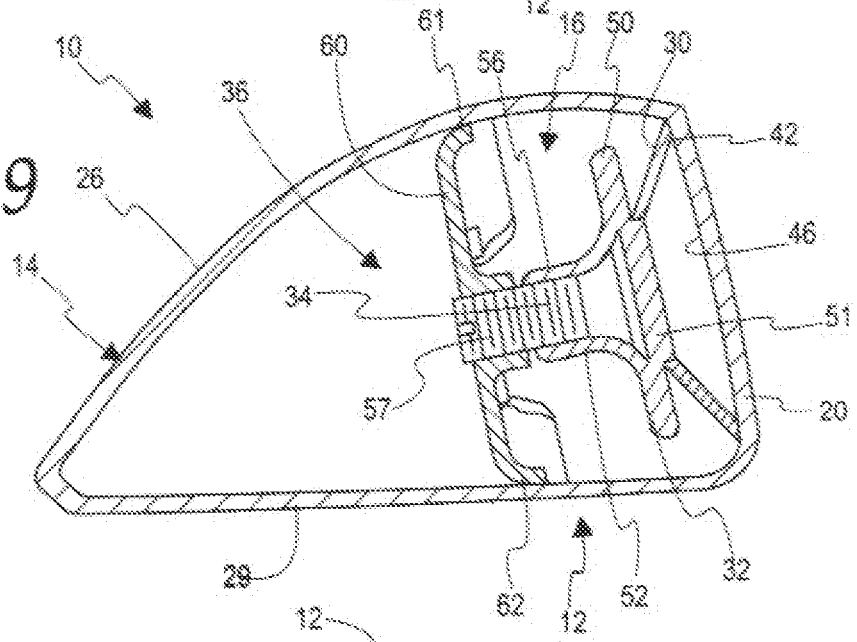
FIG. 9 is a longitudinal section of the golf club head with a high spring rate face assembly taken generally along the target line illustrating the spring and face wall support assembly in its relaxed but preloaded position.
Figure 10:
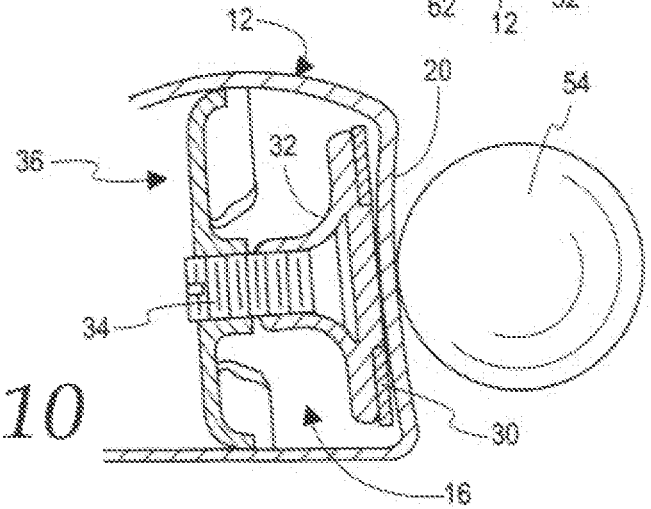
FIG. 10 is a longitudinal section of the golf club head with a high spring rate face assembly without the rear body taken generally long a vertical target line similar to FIG. 9 with the spring and face wall support illustrated in its maximum deflection position at ball impact illustrating a golf ball contacting the golf club head.
Figure 8:
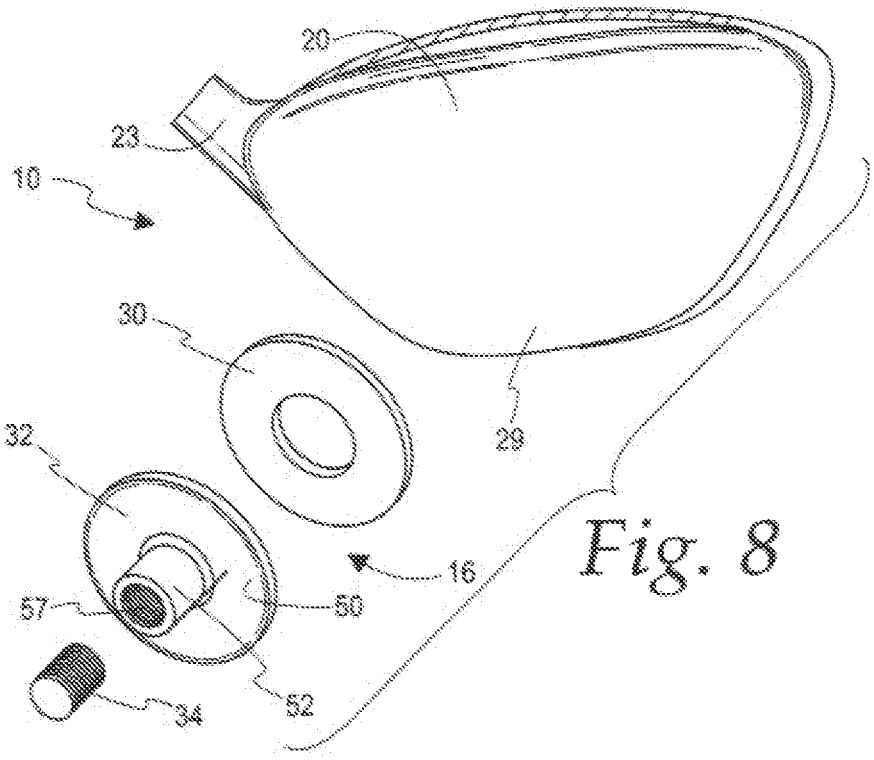
FIG. 8 is an exploded view of the cup-shaped face assembly with the spring and face wall support assembly exploded.
Figure 11:
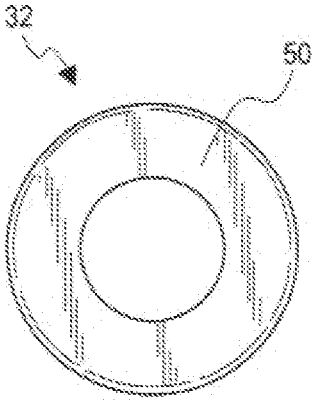
FIG. 11 is a front view of the spring seat in the golf club head with a high spring rate face assembly shown in FIGS. 9 and 10.
Figure 12:
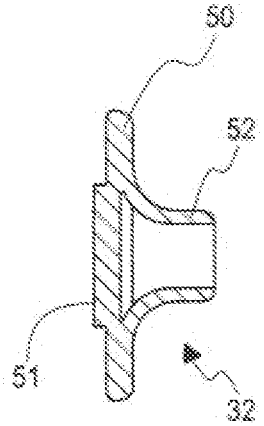
FIG. 12 is a longitudinal section of the spring seat in the golf club head with a high spring rate face assembly illustrated in FIG. 11.
Figure 13:
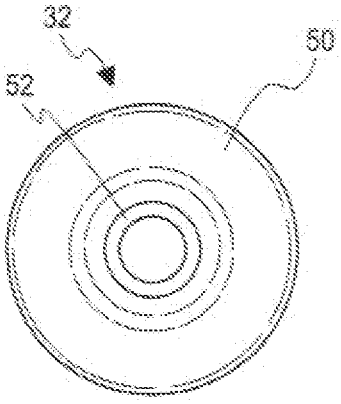
FIG. 13 is a right side view of the spring seat in the golf club head with a high spring rate face assembly illustrated in FIGS. 11 and 12.

Viewing FIGS. 8, 9 and 10, the spring and face wall support assembly 16 is seen to include an annular Belleville spring 30, a stepped spring seat 32, a preload adjusting bolt 34, and a stationary reaction assembly 36.

Figure 15:
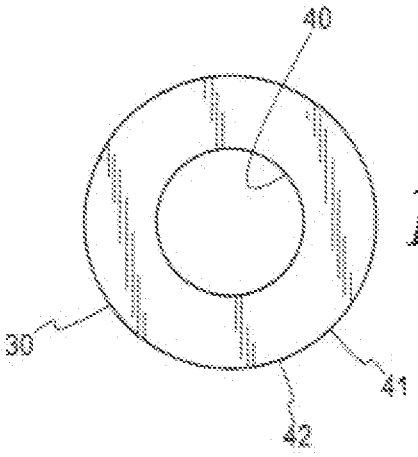
FIG. 15 is a top view of the spring in the golf club head with a high spring rate face assembly illustrated in FIG. 14; and, FIG. 16 is a side view of the Belleville spring of the golf club head with a high spring rate face assembly shown in FIGS. 14 and 15.
Figure 14:
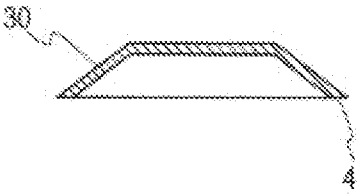
FIG. 14 is a cross section of the Belleview spring in the golf club head with a high spring rate assembly illustrated in FIGS. 9 and 10.
Figure 16:
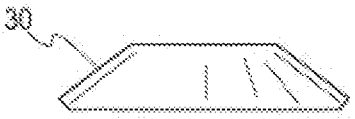

The Belleville spring 30 sub-assembly is illustrated in FIGS. 14 and 15, and is seen to be of frusto-conical configuration including an inner diameter surface 40, a frusto-conical wall 41, and an outer peripheral surface 42. Note that the surface 42 as seen in FIG. 9 is the surface engaging rear surface 46 of the face wall 20, as seen in FIGS. 9 and 10. The outer diameter of the spring 30 is selected so it is slightly less, about 0.125 inches than the smooth part of the rear surface 46.

For a low spring swing golfer in the range of 80 to 100 mph., the Belleville spring 30 has a load in its fully flattened position illustrated in FIG. 10, in the range of 1,000 to 2,000 lbs. For professional golfer swing speed of 120 to 130 mph, the spring 30 h as a maximum deflection load of 2,000 to 5,000 lbs. However, the specific spring rates and spring preloads need to be determined by the individual golf club manufacturers, so its clubs match the demographics and swing characteristics of its purchasers. But for purposes of this patent disclosure, the spring deflection forces increase with increasing swing speeds and decrease with decreasing swing speeds.

The spring 30 is preferably constructed of a carbon composite material.

Disc Springs, sometimes incorrectly called Belleville washers, are cone-shaped discs which elastically deform to a shorter height when subjected to a load along the axis of symmetry. This elastic deformation characterized the spring action.

Disc spring fabrication is subject to exacting manufacturing and quality control standards. Materials used are generally in annealed condition and hardened to within a range of Rc 44-51 depending on material thickness. All discs are preset so that they will not significantly relax under load over time.

Disc springs are used singly or in stacks to achieve a desired load and travel. In general, they function best under conditions requiring very high load in confined space or short travel. Under these constraints, it is often not practical or even possible to use a coil spring.

As a means of increasing the deflection or the load, disc springs can be used in series or parallel, or in a combination of series and parallel. Deflection for a stack in series of identical discs is equal to the number of discs multiplied by the deflection of one, while the load is equal to the load carried one disc. When the discs with an h/t ratio greater than 1.3 are used in a stack, the load-deflection curve will be erratic as some discs will invert through the flat position.

Century Spring of Los Angeles, Calif., manufactures Belleville springs suitable for this club head and also offers pre-stressed disc springs specifically sized for use with bolts. The primary function of the disc in this application is to create a constant bolt load in bolted assemblies. Load compensation for differential expansion due to heat or dissimilar metals such as electrical connection bolding, or in wear situation, or when "torgueing setting" is required are good examples of disc spring use.

Composite spring washers have a significant advantage over carbon steel because they are typically 70% lighter, non-corrosive, chemical resistant and non-magnetic. Their composite material construction provides a high strength-to-weight ratio compared to traditional metallic, construction and can be designed to provide the same functional performance as steel components.

Spring composite spring washers have a minimum tensile strength of 1,000 psi with an ultimate sheer strength of approximately 28,000 psi. They have low flammability with a maximum working temperature of 180° F. and are chemically resistant against strong acids, weak bases, alcohols, ethers, salt solution, oils and weak alkalis. These attributes make them ideally suited for the Military, Aerospace, Medical, Food Processing, Electronics, Instrumentation, Pollution Control, Semi-Conductors and Motor Racing industries, as well as many others.

An exemplary spring 30 for the low spring swing player is Part No. CDM 452213 manufactured by Century Spring. This spring has an outside diameter of 1.770 in., an inside diameter of 0.882 in., a thickness of 0.492, an overall relaxed height of 0.635 in., a load at 25% deflection of 248 lbs., a load at 50% deflection of 385 lbs., a load at 75% deflection of 447 lbs., and a load at 100% deflection, with the spring flat, as seen in FIG. 10, of 473 lbs. This is one exemplary spring for this purpose manufactured by Century Spring.

For the high swing speed player, spring 30 has a maximum deflection force in the range of 2,000 to 5,000 lbs. One exemplary spring manufactured by Century Spring is Part No. CDM-452225 that satisfies this, and has an outside diameter of 1.770 in., an inside diameter of 0.882 in., a thickness of 0.0984 in., an overall height of 0.1378 in., a load at 25% deflection of 666 lbs., a load at 50% deflection of 1,277 lbs., a load at 75% deflection of 1,851 lbs., and a load at 100% deflection(spring flat as seen in FIG. 10) of 2,406 lbs.

The loading characteristics of Belleville springs, including the spring 30, can be varied by heat treating techniques and wall thicknesses with the load values at 25, 50, 75 and 100% deflection increasing with the thickness of the spring 30.

Note that as discussed above, the spring 30 is illustrated in FIG. 9 in a preloaded position at 25% deflection or less, and the spring 30 is illustrated in FIG. 10 in its flattened position which is the 100% loading value discussed above.

Referring to FIGS. 8, 9 and 10, the spring seat 32 is a one-piece casting including an annular generally flat portion 50 having a stepped forwardly projecting annular boss 51 that seats inside the inner diameter 40 of spring 3*o* to retain the spring 30 in its lateral position during impact as the spring 30 moves to its flattened position illustrated in FIG. 10, as well as when ball 54 exits the face 20 during the rebound cycle.

Spring 30, according to the experimental limits of the present club head 10, has an outer diameter(O.D.)/overall height(O.H.) ratio of at least 10.0, an outer diameter equal to the internal height of the face wall 20 minus substantially 0.0625 inches, and a maximum load at maximum deflection in the range of 400 to 4,000 lbs.

Bolt 34 is threaded into a narrow stepped portion 56 of the seat 32. The spring seat 32 can also have a spherical ball mount for spring 30 to compensate for varying face lofts and irregularities.

Bolt 34 is threaded into the rear stationary frame assembly 36 at 57 to provide the reaction force for the preload adjustment of spring 30 by bolt 34. Bolt 34 can also be mounted loosely in seat 32 without threads to compensate for manufacturing irregularities.

The frame assembly 34 is constructed of a suitable titanium alloy including a vertical bar 60 having 90° curved ends 61 and 62 welded to cup-shaped face walls 21 and 22.

Figure 3:
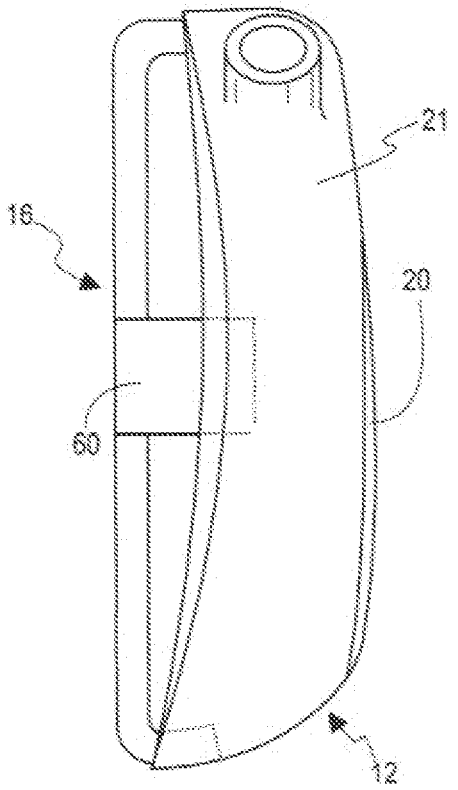
FIG. 3 is a top view of the cup-shaped face wall assembly of a golf club head with a high spring rate face assembly showing the rear portion of the spring and face wall assembly.
Figure 4:
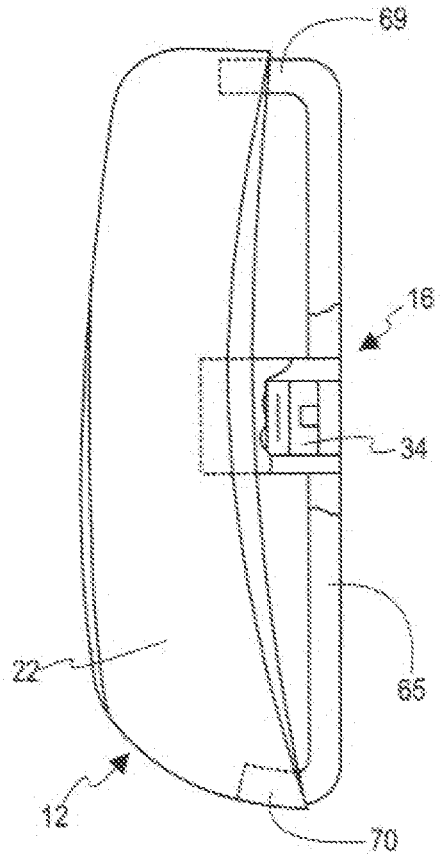
FIG. 4 is a bottom view of the cup-shaped face assembly of a golf club head with a high spring rate face assembly illustrated in FIG. 3.
Figure 5:
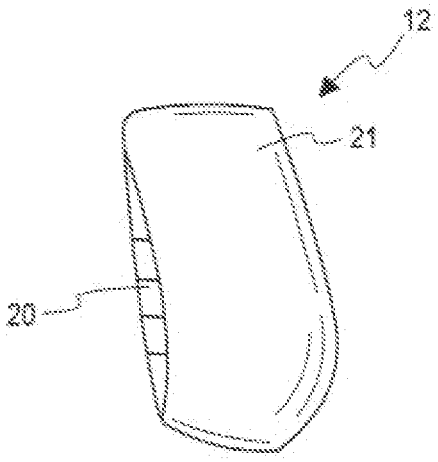
FIG. 5 is a sole side view of the cup-shaped face assembly of a golf club head with a high spring rate face assembly with the spring and face wall support assembly removed.
Figure 6:
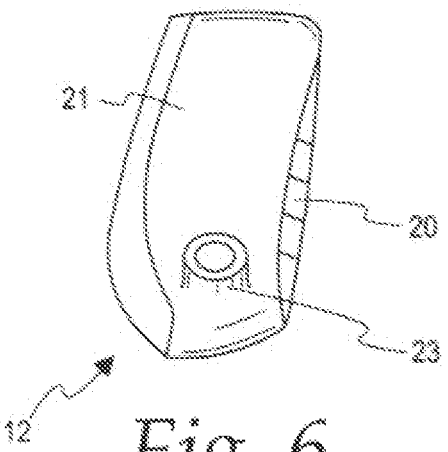
FIG. 6 is a heel side view of the cup-shaped face assembly of a golf club head with a high spring rate face assembly with the spring and face wall assembly removed.
Figure 7:
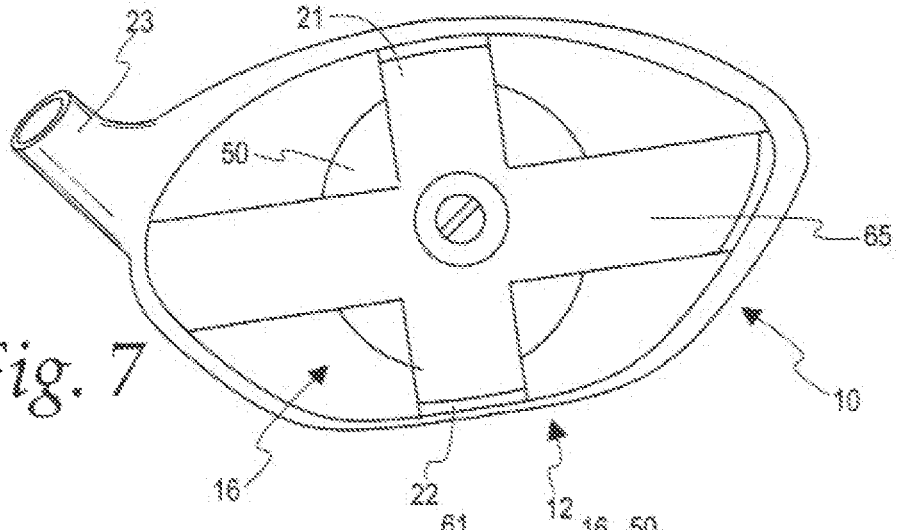
FIG. 7 is a rear view of the cup-shaped face assembly of a golf club head with a high spring rate face assembly with the spring and face wall support assembly installed.

Assembly 36 also includes a horizontal frame bar 65 welded to vertical bar 60 and having 90° ends 69 and 70 welded into the toe and heel portions of the cup-shaped face assembly 12, as seen clearly in FIGS. 3 and 4.

Figure 17:
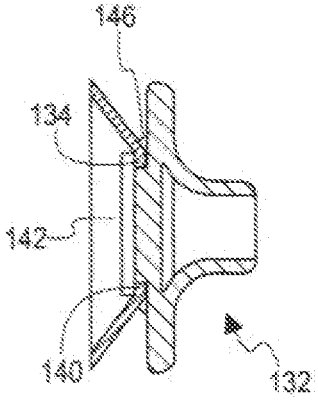
FIG. 17 is a cross section of an alternative spring seat in the golf club head with a high spring rate face assembly.

FIG. 17 shows an alternative spring seat 132, an annular recess 134 in circular pilot 151, spring 130 has an internal diameter 140 that is press fit over the outer surface of pilot portion 142 and snaps into recess 134 and fixed therein by an annular epoxy bead 146 or weldment. This mount of spring 130 reduces spring oscillation and noise at impact.

The invention claimed is:

1. A club head with increased spring effect and face wall support integrity, comprising: a club head including a club head body with a toe portion, a heel portion, a hosel extending generally upwardly, a face wall having a forward ball striking surface and a rear surface and a central target line, said face wall having a thickness between the forward surface and the rear surface, and a club face spring and bias assembly mounted in the club head body behind the club face including an annular spring biasing the club face along said target line and engaging the rear surface of said face wall around said target line, a spring seat adjacent the rear of the spring for varying the force of the spring against the club face, said spring having a height in the direction of the target line, and an outer dimension so it exerts a force over a substantial area of the club face, said spring outer dimension being substantially greater than its height so the spring and bias assembly occupies a smaller volume inside the club head body, said club face spring and bias assembly has a maximum load at a maximum deflection value over 2000 lbs. for high swing speed players.

2. A club head with increased spring effect and face wall support integrity as defined in claim 1, wherein the spring is a Belleville spring having an annular outer periphery surface and a circular inside annular surface with a frusto-conical annular body between the outer periphery and the inside diameter, and a frame fixed to the club head body and supporting the spring seat against movement.

3. A club head with increased spring effect and face wall support integrity as defined in claim 2, wherein the Belleville spring having an annular outer surface engaging the rear surface of the face wall, said spring seat having a portion engaging the inside surface of the Belleville spring to permit limited movement of the Belleville spring during ball impact.

4. A club head with increased spring effect and face wall support integrity as defined in claim 2 said frame being fixed to the toe portion of the club head body and the heel portion of the club head body and has a portion extending over and supporting the spring seat.

5. A club head with increased spring effect and face wall support integrity as defined in claim 1, wherein the spring seat exerts a substantial static force against the spring to preload the spring against the club face to increase club face resistance to ball impact during an early portion of the face wall deflection beginning at initial impact of the club face against the ball.

6. A club head with increased spring effect and face wall support integrity, comprising: a club head including a club head body with a toe portion, a heel portion, a hosel extending generally upwardly, a face wall having a forward ball striking surface and a rear surface, said face wall having a thickness between the forward surface and the rear surface with a central target line, an annular spring behind the club face wall having an annular surface engaging the rear surface of the face wall around said target line, said spring having a height in the direction of the target line and a width extending across the rear surface of the face wall, said spring height being substantially less than the spring width, and a spring seat behind and engaging the spring, said annular spring having a maximum load at a maximum deflection value of less than 2,000 lbs. for slower swing speed players.

7. A club head with increased spring effect and face wall support integrity as defined in claim 6, said spring seat biasing the spring against the face wall with a substantial preload, and a lateral frame in the club head body fixed to the spring, and a frame fixed to the club head body and supporting the spring seat against movement.

8. A club head with increased spring effect and face wall support integrity as defined in claim 7, wherein the frame is fixed to the toe portion of the club head body and the heel portion of the club head body and has a portion extending over and supporting the spring seat.

9. A club head with increased spring effect and face wall support integrity as defined in claim 6, wherein the spring has an outer diameter to overall height ratio of 10 to 1.

10. A club head with increased spring effect and face wall support integrity as defined in claim 6, and said spring being a Belleville spring having a circular outer periphery surface and a circular inside diameter surface, said Belleville spring annular outer surface engaging the rear surface of the face wall, said spring seat having a portion engaging the inside diameter surface, said spring having a frusto-conical portion between the outer surface and the inside diameter surface, said Belleville spring annular outer surface engaging the rear surface of the face wall, said spring seat portion engaging the inside diameter surface of the Belleville spring to permit limited movement of the Belleville spring during ball impact.

11. A club head with increased spring effect and face wall support integrity as defined in claim 6, wherein the spring seat exerts a static force against the spring to preload the spring against the club face to increase club face resistance to ball impact during an early portion of the face wall deflection beginning at initial impact of the club face against the ball.

12. A club head with increased spring effect and face wall support integrity as defined in claim 6, wherein the Belleville spring has a maximum load at maximum deflection over 2,000 lbs. for high swing speed players.

13. A club head with increased spring effect and face wall support integrity as defined in claim 6, wherein the Belleville spring has a maximum load at maximum deflection less than 2,000 lbs. for slower swing speed players.

14. A club head with increased spring effect and face wall support integrity, comprising: a club head including a club head body with a toe portion, a heel portion, a hosel extending generally upwardly, a face wall having a forward ball striking surface and a rear surface with a central target line, said face wall having a thickness between the forward surface and the rear surface, and a club face spring and bias assembly mounted in the club head body behind the club face including an annular spring biasing the club face along a target line and centered on the club face target line, a spring seat adjacent the rear of the spring for varying the force of the spring against the club face, said spring having a height in the direction of the target line and an outer dimension so it exerts a force over a substantial area of the club face, said spring outer dimension being substantially greater than its height so the spring and bias assembly occupies a smaller volume inside the club head body wherein the spring is a Belleville spring having a circular outer periphery surface and a circular inside diameter surface with a frusto-conical body between the outer periphery surface and the inside diameter.

15. A club head with increased spring effect and face wall support integrity as defined in claim 14, wherein the Belleville spring annular outer surface engages the rear surface of the face wall, said spring seat having a portion engaging the inside diameter of the Belleville spring to permit limited movement of the Belleville spring during ball impact, and a frame fixed to the club head body and supporting the spring seat against movement, said frame is fixed to the toe portion of the club head body and the heel portion of the club head body and has a portion extending over and supporting the spring seat.

16. A club head with increased spring effect and face wall support integrity as defined in claim 14, wherein the spring seat exerts a static force against the spring to preload the spring against the club face to increase club face resistance to ball impact during an early portion of the face wall deflection beginning at initial impact of the club face against the ball, said spring having an outer diameter to overall height ratio of 10 to 1.

17. A club head with increased spring effect and face wall support integrity as defined in claim 14, wherein the Belleville spring has a maximum load at maximum deflection over 2,000 lbs. for high swing speed players.

18. A club head with increased spring effect and face wall support integrity as defined in claim 14, wherein the Belleville spring has a maximum load at maximum deflection less than 2,000 lbs. for slower swing speed players.

19. A club head with increased spring effect and face wall support integrity as defined in claim 14, wherein the spring has an outer diameter to overall height ratio of 10 to 1.

* * * * *